US005368164A

United States Patent [19]

Bennett et al.

[11] Patent Number: 5,368,164

[45] Date of Patent: Nov. 29, 1994

[54] TOOL SET APPARATUS

[75] Inventors: Jeffrey E. Bennett, Newhall, Calif.; Tseng Y. Chuan, Taichung Hsien, China

[73] Assignee: Allied Wholesale, Inc., Sylmar, Calif.

[21] Appl. No.: 160,071

[22] Filed: Nov. 30, 1993

[51] Int. Cl.[5] ..... B65D 85/24

[52] U.S. Cl. ..... 206/373; 206/376; 206/379

[58] Field of Search ..... 206/372, 373, 376, 377, 206/378, 379, 477, 483, 493

[56] References Cited

U.S. PATENT DOCUMENTS

| | | | |
|---|---|---|---|
| 2,403,825 | 7/1946 | Nissenbaum | 206/379 |
| 3,583,556 | 6/1971 | Wagner | 206/373 |
| 3,870,149 | 3/1975 | Huot | 206/379 |
| 4,927,020 | 5/1990 | Randy | 206/378 |
| 4,987,998 | 1/1991 | Tsai | 206/372 |
| 5,284,245 | 2/1994 | Slivon et al. | 206/378 |

FOREIGN PATENT DOCUMENTS 2224491 9/1990 United Kingdom .

OTHER PUBLICATIONS

Six pages illustrating drill cases and drill sets which are purportedly from a German company's catalog dating from 1990.

*Primary Examiner*—Jacob K. Ackun, Jr.
*Attorney, Agent, or Firm*—Lyon & Lyon

[57] ABSTRACT

A tool set apparatus for various tools and accessories for tools. The invention includes adaptable and rotatable flip indexes to secure drill bits, power bits, screwdriver bits, keys, sockets, chucks or other tools in a tray or easy to carry blow molded case. The specific flip index or tool required may be grasped and removed from the apparatus for a specific task. A removable slide member allows a specific tool to be releasably engaged and secured. The flip index adapts to the changing collection of tools as various sizes of tools can be selectively positioned on the flip index. A notch in the slide member allows the slide member to securely hold the tool.

28 Claims, 6 Drawing Sheets

FIG. 8.
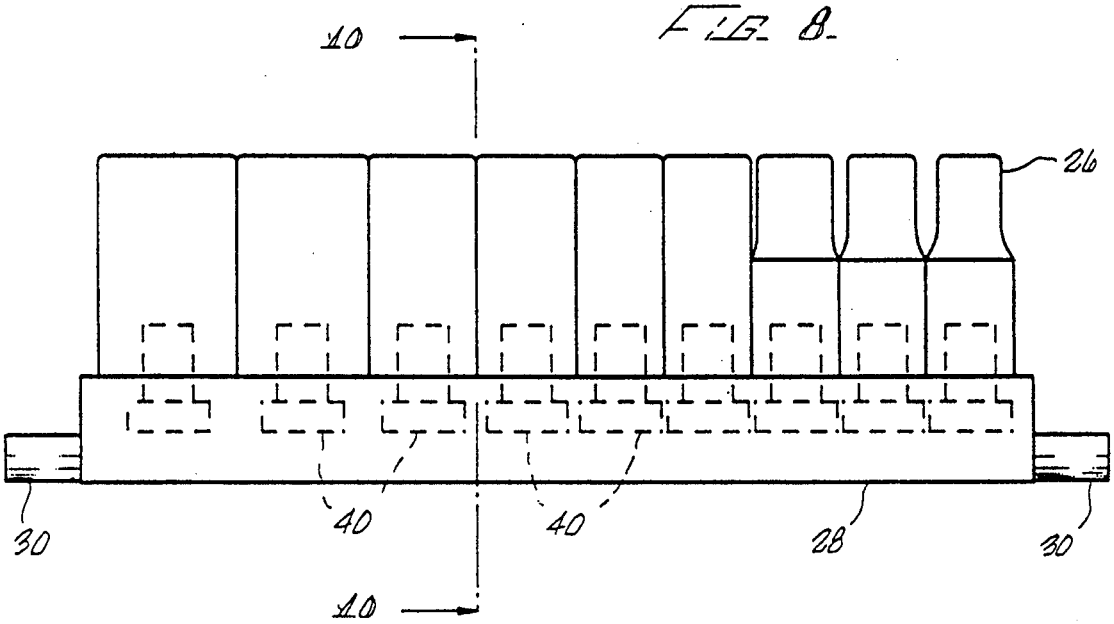
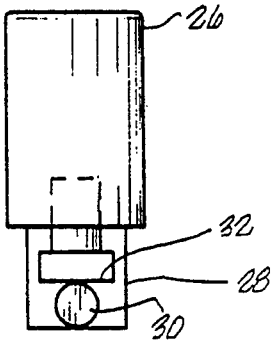
FIG. 9.
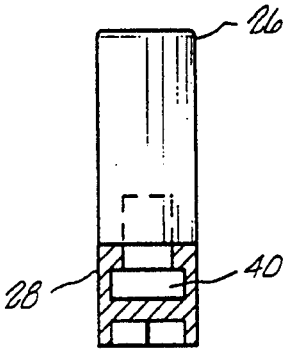
FIG. 10.

TOOL SET APPARATUS

The field of the invention is storage apparatus for hand or power tool implements. In almost every home or factory, many sizes of tools and their accessories are needed for different jobs. Therefore, to try to organize and store these tools and accessories, a conventional tool case is generally used to store different kinds and sizes of tools and accessories.

One conventional tool storage case has several layers of rotating "boxes" laying one on top of another in a stacked configuration. This arrangement makes it difficult to get a tool in the middle layers because of inconvenient stacking and the limited space around each layer. Conventional tool storage boxes are also made of metal and as a result, it takes more time to assemble them, they are more expensive and they are not easy to carry. Traditional cases are not adaptable to store varying kinds or sizes of tools. One conventional tool storage case utilizes individual spring steel clips to hold only sockets. These clips are shaped to slide onto a "C" shaped section for storage or display purposes.

The present invention is an advancement beyond the conventional tool storage devices. One feature of the preferred embodiment includes rotatable indexes or "flip indexes" for easy access and deployment of individual tools. Another feature of the invention comprises a blow molded case to store or display the flip indexes. In the preferred embodiment, a bottom tray and a lid are rotatably attached to allow the apparatus to be closed and carried much like a briefcase. One or more flip indexes are releasably secured in different compartments of the tray. The flip index is removably attached to the bottom tray through one or more studs and may be rotated up from the tray surface, thus forming an angle to the tray, or it may simply be removed from the tray. This facilitates the deployment of the particular tool item, such as a socket, drill bit, screwdriver bit, hex key, chuck or other tool.

Another feature is the easy to manipulate slide member. The slide member is removable from the flip index and thus allows a single tool to be removed from the apparatus. The slide member may provide either a male end or a female end to store and deploy a tool. One additional feature is that the slide members can "adjust" their respective positions on the base of the flip index so, for example, one flip index can accommodate different size tools. Therefore, the present invention adapts to one's changing collection of tools.

Accordingly it is an object of the present invention to provide an adaptable tool set apparatus. Another object is to provide a flip index which can adjust to releasably secure and deploy different kinds and sizes of tools having a male end and a female end. Other and more detailed objects and advantages will appear to those skilled in the art from the following description and the accompanying drawings, wherein.

Figure 4A:
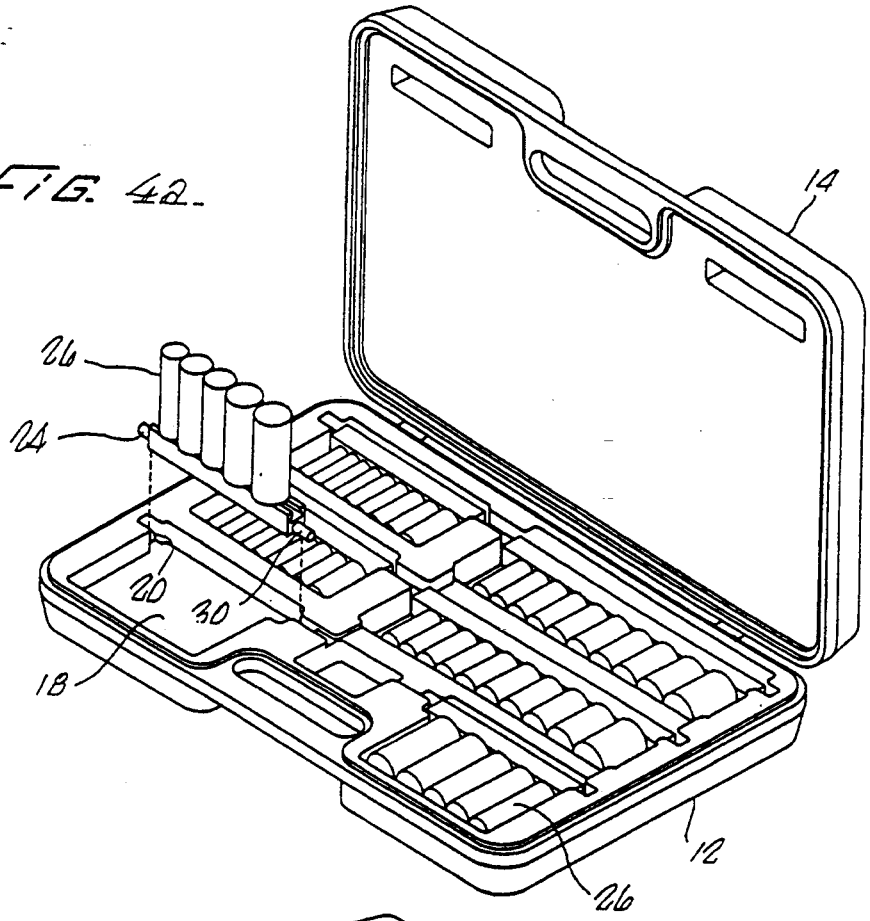
Figure 4B:
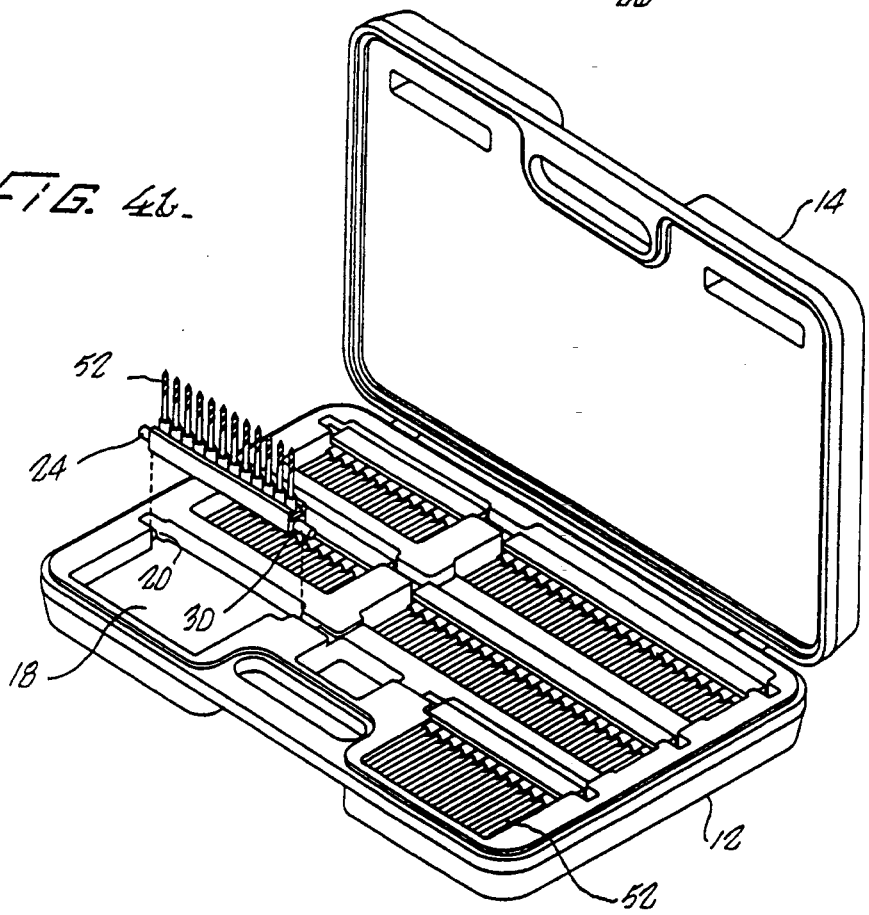
Figure 5:
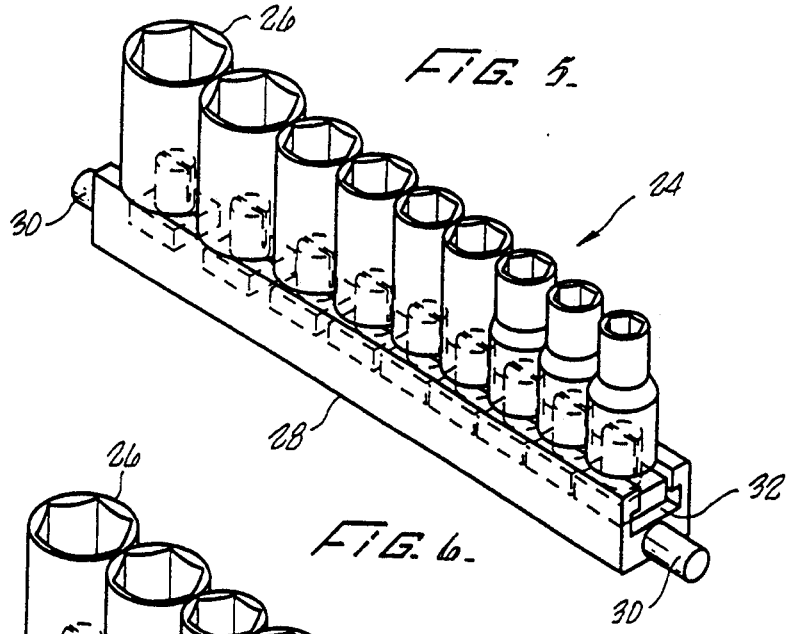
Figure 6:
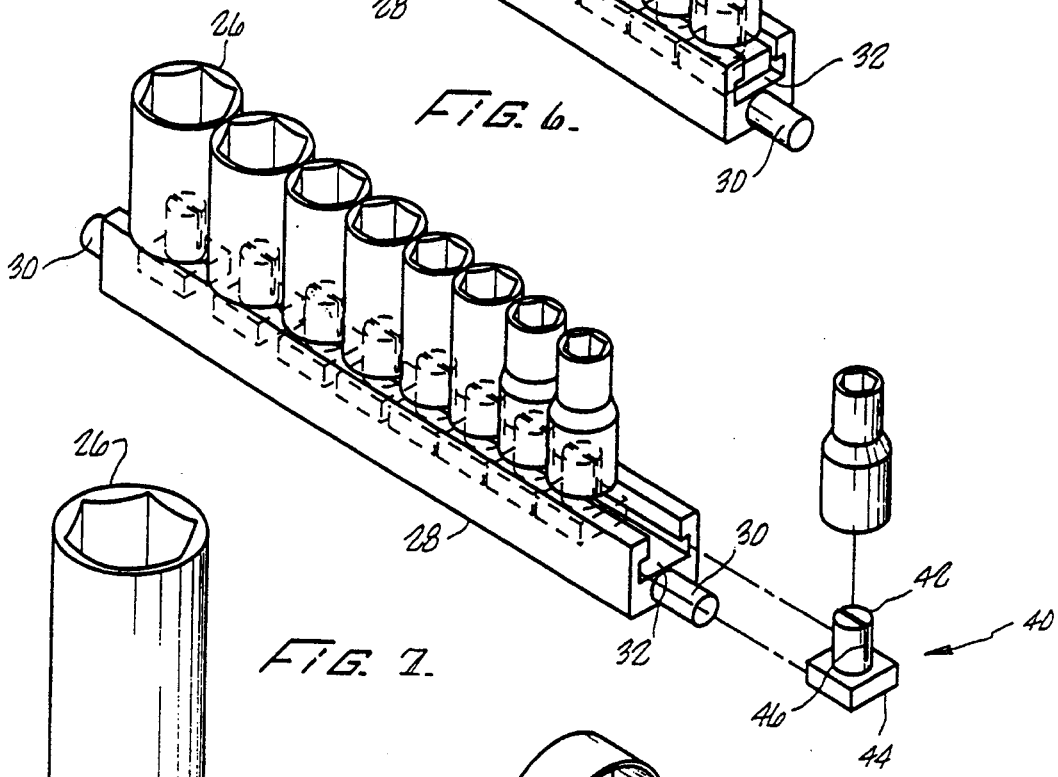

FIG. 4*a* is a front three-quarters perspective view illustrating the removal of a flip index and the attached sockets;

FIG. 4*b* is a front three-quarters perspective view also illustrating the removability feature of the flip index with drill bits;

FIG. 5 is a perspective view of a flip index, illustrating the base, the channel, the slide members (shown in phantom) and the releasably attached sockets. The studs are also shown in this Figure;

FIG. 6 further illustrates the slide member, the rod, the guide, and the notch.

Figure 7:
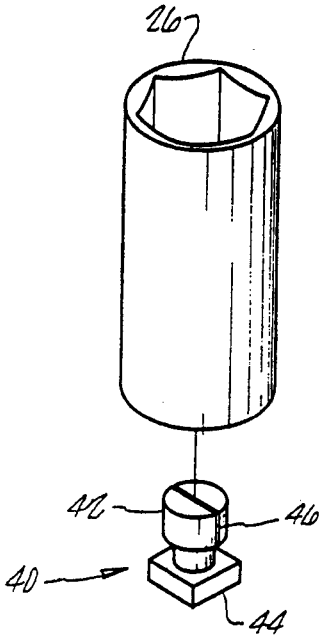
Figure 7A:
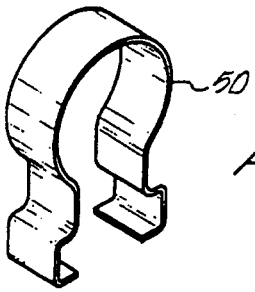
Figure 7B:
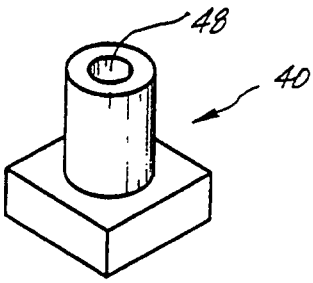
Figure 1C:
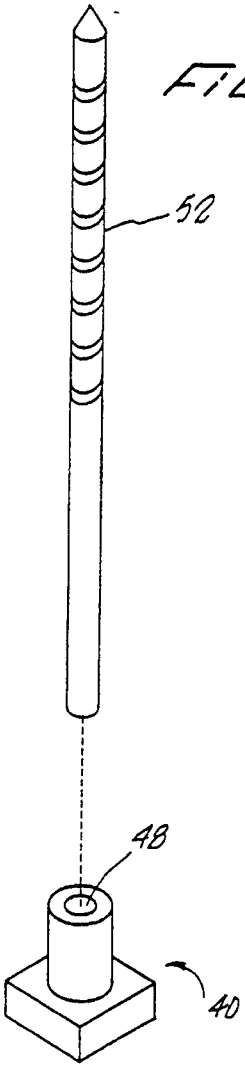
Figure 1E:
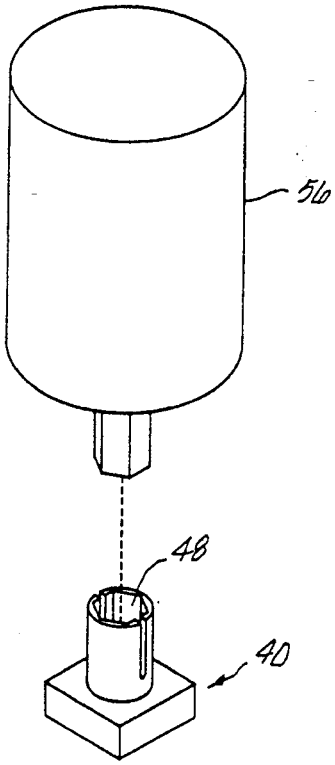
Figure 1D:
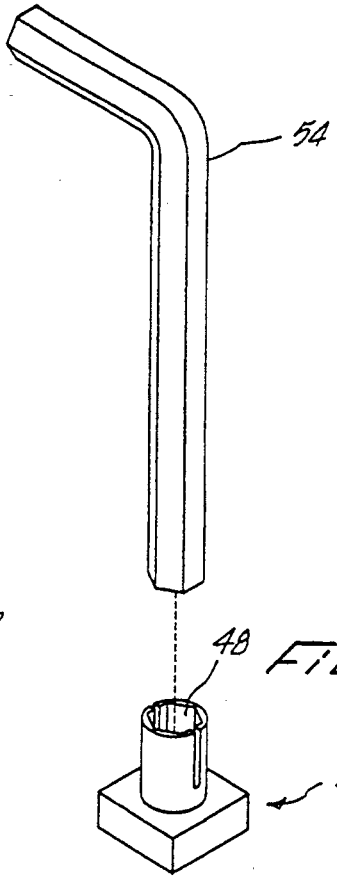
Figure 1F:
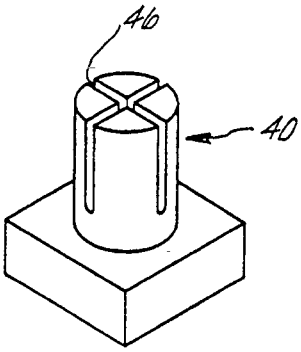
Figure 1G:
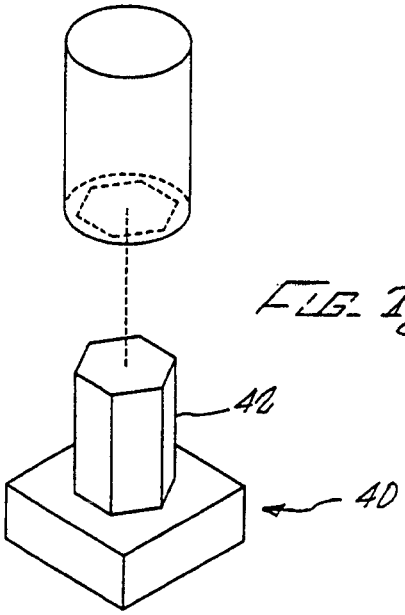
Figure 1H:
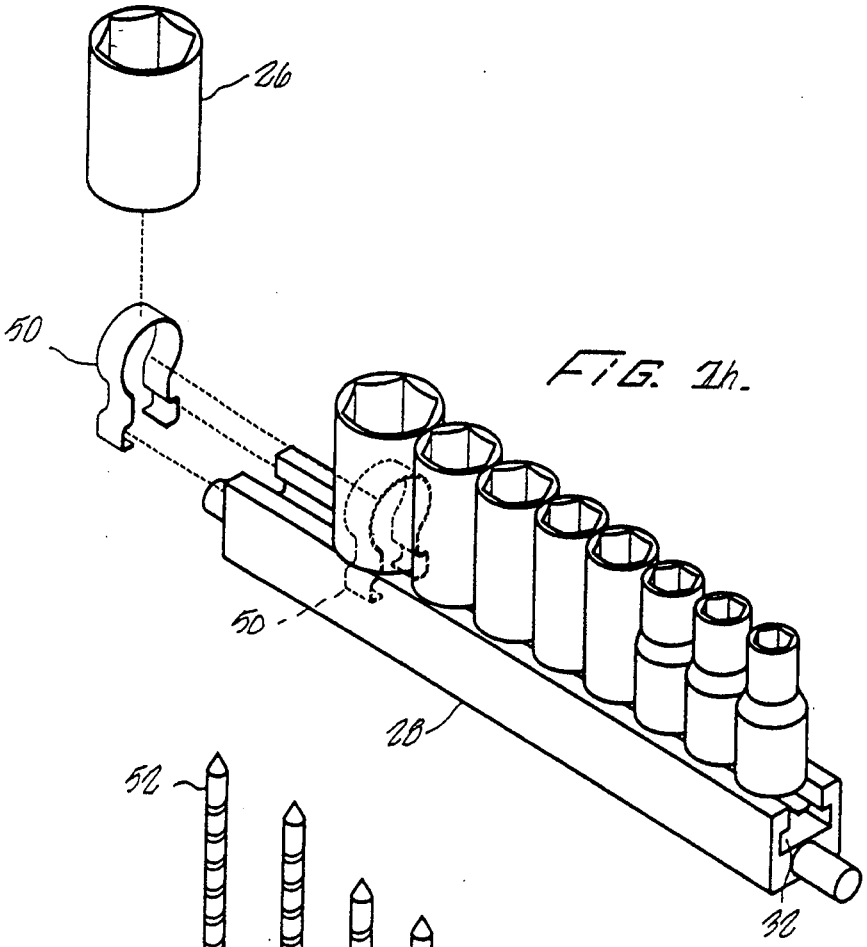
Figure 1I:
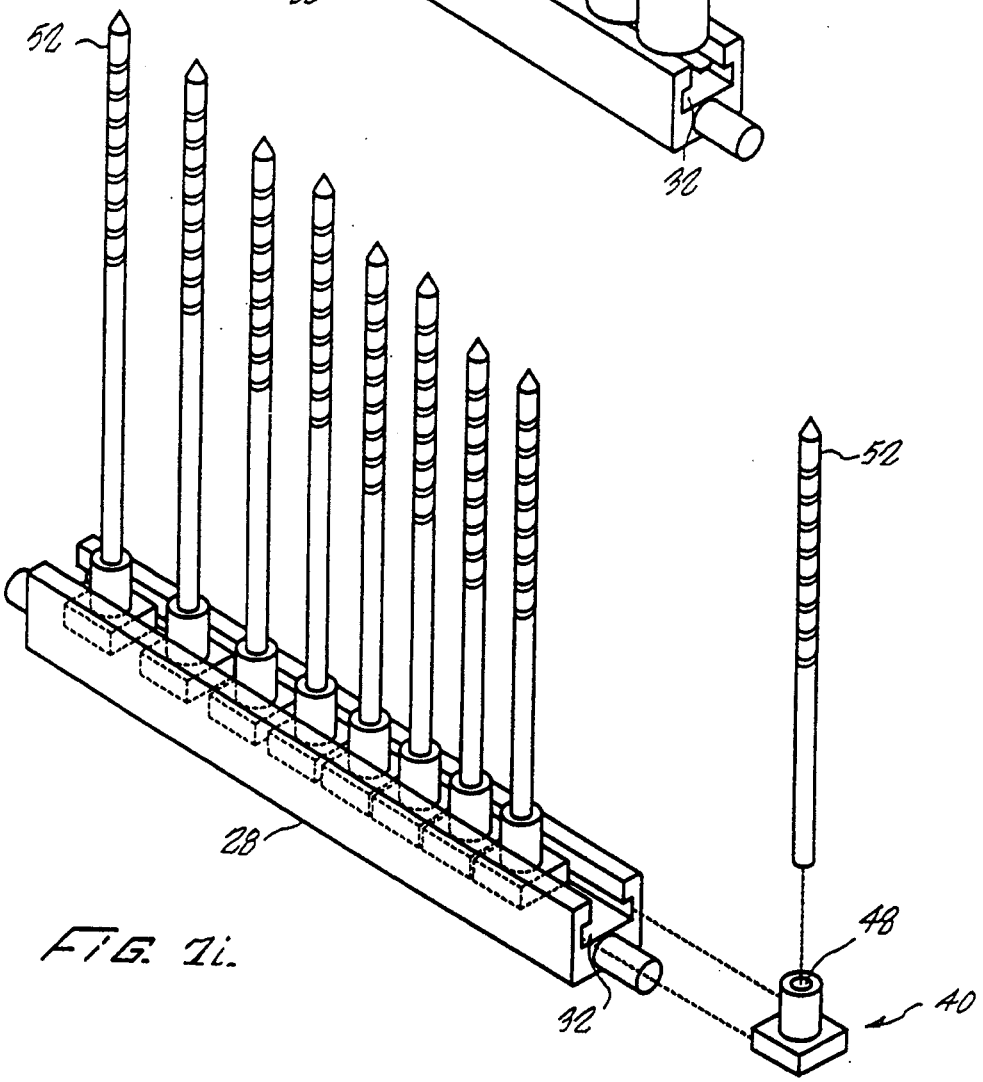

FIG. 7 illustrates one feature of the slide member with a rod having a nonuniform diameter;

FIG. 7*a* shows one embodiment of the slide member as a coil shape;

FIG. 7*b* shows a female end feature on the slide member;

FIG. 7*c* illustrates a slide member with a female end and the accompanying drill bit;

FIG. 7*d* illustrates the slide member with a female end feature and a notch along with an accompanying hex key to be releasably stored or deployed;

FIG. 7*e* shows a tool with a male end and its positioning into the slide member;

FIG. 7*f* illustrates another feature of the notch with multiple slots;

FIG. 7*g* shows another feature of the slide member with a male end which will releasably store or deploy a tool having a female end;

FIG. 7*h* shows the coil shape deployed onto the flip index for releasable storage and deployment of sockets;

FIG. 7*i* shows the slide member with the female end releasably storing and deploying male end tools such as drill bits;

FIG. 8 is a front view of a flip index illustrating relative positions of slide members on the base;

FIG. 9 is a side view of the flip index; and

FIG. 10 is a section view taken along line 10—10 of FIG. 8 also illustrating the flip index.

Figure 1:
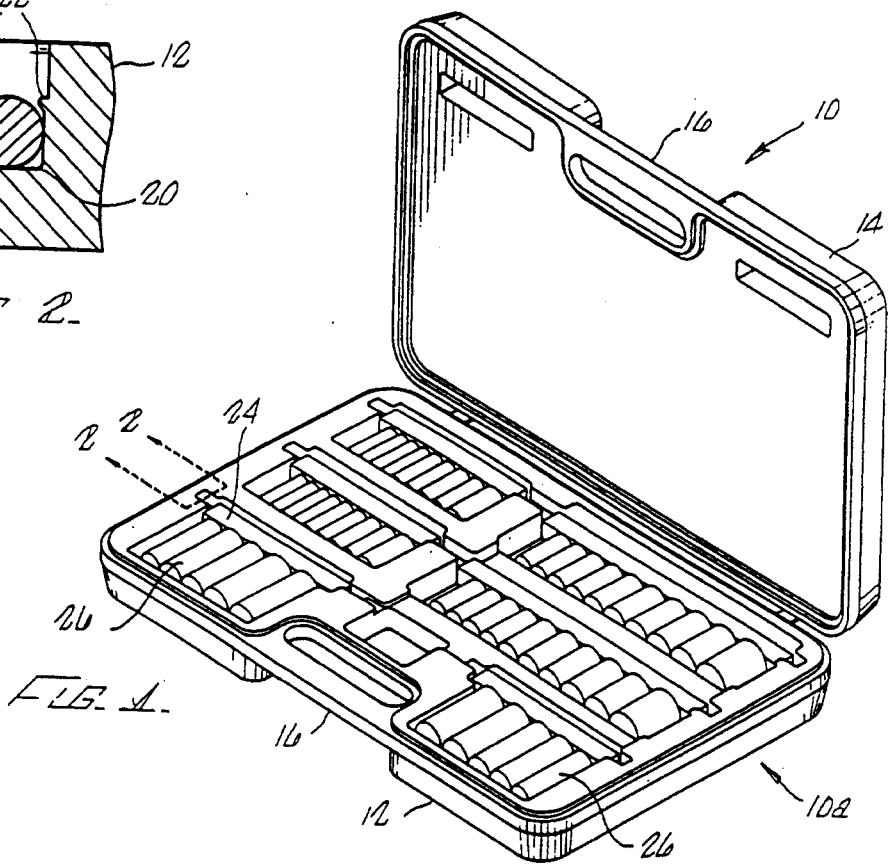
FIG. 1 is a front three-quarters perspective view of one embodiment of the present invention illustrating the blow molded case.
Figure 3:
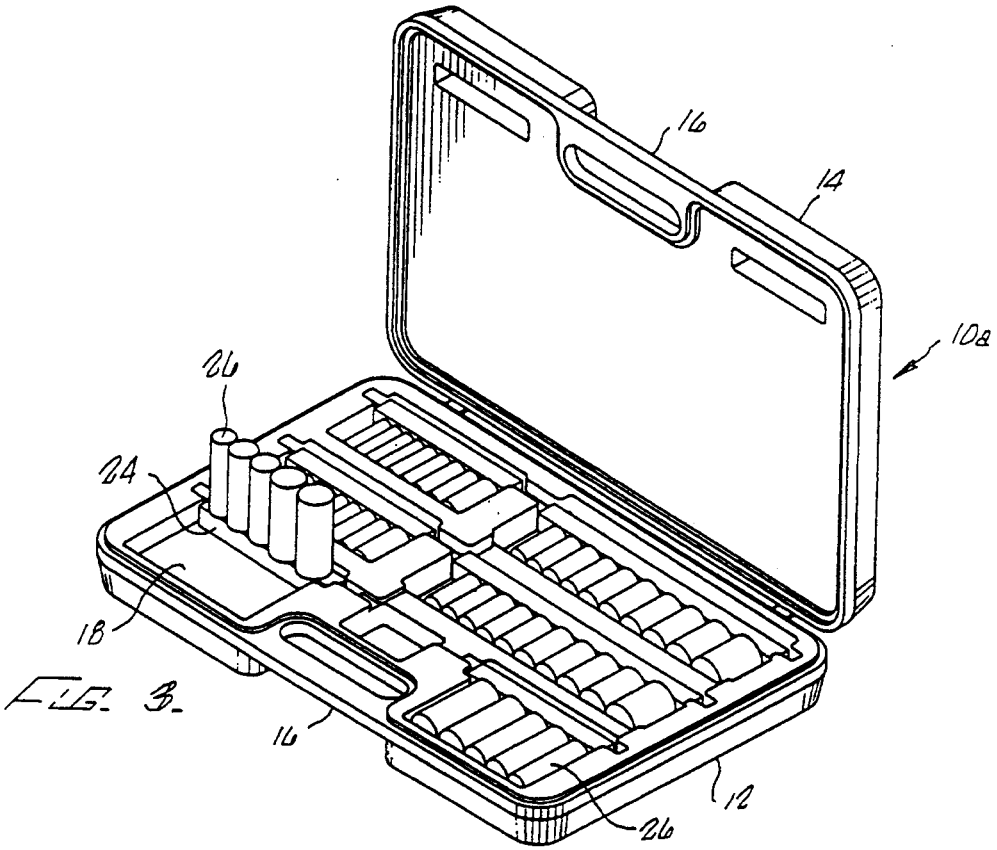
FIG. 3 is a front three-quarters perspective view which illustrates a flip index that has been rotated up from the blow molded case.

Turning now to the figures, FIG. 1 illustrates the tool set apparatus 10, which is also shown in FIGS. 3 and 4. In FIG. 1, a generally rectangular tray 12 or bottom portion and the lid 14 or top portion are shown pivotally attached. When in a closed position, the tray 12 and the lid 14 form the handle 16 and secure the contents within. As illustrated in FIGS. 1, 3 and 4, the blow molded case 10*a* is shown. The case 10*a* is made of plastic.

Figure 2:
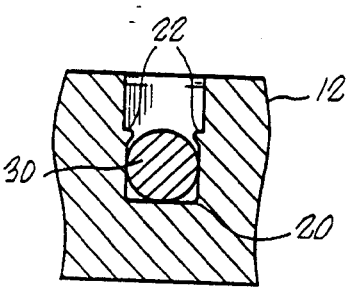
FIG. 2 is a section view taken along line 2—2 of FIG. 1 illustrating the stud placement in the receptacle.

As shown in FIG. 1, the tray 12 has a series of recessed compartments 18 thereon. Receptacles 20 are positioned on opposing sides of the compartments 28 to rotatably secure removable flip indexes 24. To releasably secure the flip indexes 24, the receptacles are provided with detents 22 as shown in FIG. 2 whereby studs 30 secure the flip index 24 to the respective receptacles 20 adjacent to the detents 22. As shown in FIG. 3, the flip index 24 may be rotated up from the tray 12 by pivoting the flip index about the studs 30.

As shown in FIG. 4*a*, the flip index 24 may be removed from the tray 12 by hand pressure pulling the studs 30 out from behind the detents 22. In this embodiment, numerous flip indexes 24 may be stored in a particular tray 12 and may secure a plurality of sockets 26 as shown in FIGS. 1, 3 and 4*a*. As an alternative or as a complement to the storage of sockets 26, the present invention may releasably store other male ended tools such as drill bits 52 as shown in FIG. 4*b*.

Turning now to FIG. 5, a flip index 24 of the preferred embodiment is shown. The base 28 includes a channel 32 which is shaped to slidably receive the slide members 40. The channel 32 extends longitudinally through the base 28 as shown in the Figures. Numerous slide members 40 may be positioned on the base 28 thus allowing various sized sockets 50 to be snugly secured on a single base 28. In the preferred embodiment, the slide members 40 allow a selective arrangement of various size sockets 26 on a base 28.

As shown in FIG. 5, larger sized sockets 26 can be stored on the base 28 by selectively positioning the slide members 40 further apart. Alternatively, smaller sockets 26 can be stored on the base 28 adjacent to larger sockets 26 by selectively positioning the slide members 40 either closer together or further apart.

As shown in FIG. 6, the slide member 40 includes a rod 42 extending from a guide 44 in the preferred embodiment. The guide 44 is shaped to be slidably and removably received within the channel 32 of the base 28. As one feature, a notch 46 is provided on the rod 42 and is shown in FIG. 6. This notch 46 allows for a secure fit between the socket 26 and the rod 42 as the notch 46 allows the upper portion of the rod 42 to compress or narrow the notch opening, to snugly match the drive opening or female end of the socket 26 or other female ended tool. As shown in FIG. 7, the rod 42 may be of a nonuniform diameter, thus permitting larger sockets 26 or sockets 26 with larger drive sizes to be accommodated by the present invention.

The slide member 40 as shown in FIG. 7*a* may alternatively be a shaped coil 50 which is coiled to secure a tool and fit within the channel 32. The slide member 40 may alternatively secure another tool such as a drill bit 52 or key 54 where an aperture 48 or female end is provided as shown in FIG. 7*b*. The mating of the drill bit 52 with the aperture 48 and slide member 40 is shown in FIG. 7*c*. The engagement between a hex key 54 and an aperture 48 on a slide member 40 is shown in FIG. 7*d*. FIG. 7*e* shows a male ended tool 56 engaging the aperture 48 and slide member 40 of the present invention. The invention may additionally releasably store and deploy male ended or female ended tools such as screwdriver bits and chucks to name just a few.

Turning to FIG. 7*f*, another notch 46 feature of the present invention is shown with multiple slots to accommodate a variety of tool sizes and shapes. As shown in FIG. 7*g*, the rod 42 may have a noncylindrical shape to also accommodate a variety of tools and the present invention includes noncylindrical shaped rods 42. Referring to FIG. 7*h*, the shaped coil 50 is shown releasably secured to the bar 28 while allowing for the releasable storage and deployment of numerous sockets 26. FIG. 7*i* shows an alternative embodiment of the present invention with slide members 40 comprising female ends 48 releasably storing and deploying male ended tools such as drill bits 52.

Turning to FIG. 8, a frontal view of the base 28 is shown with the selective positioning of the slide members 40 shown in phantom to allow for placement of various sizes of sockets 26 on the base 28 adjacent to each other. FIG. 9 shows an end view of the base 28 with a socket 26 secured to a rod 42 of a slide member 40. The elevation section view of FIG. 10 shows the relative position of the slide member 40 and an attached socket 26.

While the preferred embodiment of the present invention and modifications thereto have been shown and disclosed in the drawings and specification, alternate embodiments of the present invention may be apparent to the person of ordinary skill in the art and this application is intended to include those embodiments within the full breadth and scope of the claims. Moreover, the present invention need not include all of the features disclosed in the single embodiment but rather one or more features may be included.

What is claimed is:

1. A closeable apparatus for tool storage, comprising: a tray, one or more flip indexes pivotally secured to said tray, said flip indexes having a base, said base including a channel extending longitudinally through said base, one or more slide members, said slide members having a rod secured to a guide, said slide members adapted to be slidably and selectively positioned onto said base by controlled longitudinal movement of said guide in communication with said channel.

2. The apparatus of claim 1 where said one or more slide members are removable from said base.

3. The apparatus of claim 1, said base further comprises one or more studs positioned on opposite ends of said base, said one or more studs adapted to engage receptacles on said tray to allow controlled pivoting movement of said base while said base is attached to said tray.

4. The apparatus of claim 1 where said flip index is removable from said apparatus.

5. The apparatus of claim 3 where said flip index is removable from said apparatus.

6. The apparatus of claim 1 where said rods are of a cylindrical shape.

7. The apparatus of claim 1 where said rods are of a cylindrical shape and some of said rods have a larger diameter.

8. The apparatus of claim 1 where said apparatus comprises a blow molded case.

9. The apparatus of claim 1 where said rods are of a cylindrical shape and some of said rods have a nonuniform diameter.

10. The apparatus of claim 1 where said slide members releasably engage and secure a female end on a tool or a male end on a tool.

11. A blow molded case, one or more tool support means pivotally and releasably secured to said blow molded case, said one or more tool support means having a channel means, and one or more tool deployment means, said one or more tool deployment means adapted to be slidably and selectively positioned onto said tool support means by controlled longitudinal movement in communication with said channel means.

12. The apparatus of claim 11 where said tool support means further comprises one or more studs, said studs adapted to engage receptacles on said blow molded case to allow controlled pivoting movement of said tool support means while said tool support means is attached to said case.

13. The apparatus of claim 11 where said tool deployment means comprise cylindrical shaped rods and some of said rods have a larger diameter or a nonuniform diameter.

14. The apparatus of claim 11 where said one or more tool deployment means are removable from said tool support means.

15. The apparatus of claim 11 where said tool support means is removable from said blow molded case.

16. The apparatus of claim 11 where said tool deployment means comprise a male end portion to releasably secure a tool.

17. The apparatus of claim 11 where said tool deployment means comprise a female end portion to releasably secure a tool.

18. The apparatus of claim 11 where said tool deployment means releasably engages and secures a female end on a tool or a male end on a tool.

19. The apparatus of claim 11 where said tool deployment means further comprises a notch.

20. A closeable apparatus for tool storage comprising:

a bottom portion, one or more flip indexes pivotally and releasably secured to said bottom portion, said one or more flip indexes each comprising a base, said base comprising a channel; and a plurality of slide members, said slide members including a rod secured to a guide, said rods comprising a notch, said slide members adapted to be slidably and selectively positioned onto said base by controlled longitudinal movement of said guide in communication with said channel.

21. The apparatus of claim 20 where said notch is adapted to bias said rod so that said rod releasably engages and secures a tool.

22. The apparatus of claim 20 where said notch permits a portion of said rod to compress to releasably engage and secure a tool.

23. The apparatus of claim 20 where said base comprises one or more studs, said studs adapted to releasably engage receptacles on said tray and said one or more flip indexes are removable from said tray.

24. The apparatus of claim 20 where said rods are cylindrically shaped and some of said rods have a larger diameter or a nonuniform diameter.

25. The apparatus of claim 20 where said apparatus comprises a blow molded case.

26. A closeable blow molded case for tool storage comprising:

a bottom portion and a top portion, one or more bases pivotally and releasably secured to said bottom portion, said one or more bases each including a channel; and a plurality of slide members, said slide members having a rod secured to a guide, said rods comprising a notch, said slide members adapted to be slidably and selectively positioned onto one or more of said bases by controlled longitudinal movement of said guide in communication with said channel.

27. The apparatus of claim 26 where said rod releasably engages and secures a female end on a tool or a male end on a tool.

28. A flip index comprising:

a base having a channel extending longitudinally through said base and at least one stud on said base adapted to releasably engage at least one receptacle in a tray;

one or more slide members positioned on said base, said slide members having a rod secured to a guide, said slide members adapted to be slidably and selectively positioned onto said base by controlled longitudinal movement of said guide in communication with said channel.

* * * * *